US011776779B2

(12) United States Patent
Morelli et al.

(10) Patent No.: US 11,776,779 B2
(45) Date of Patent: Oct. 3, 2023

(54) MEDIUM VOLTAGE SWITCHING APPARATUS

(71) Applicant: ABB Schweiz AG, Baden (CH)

(72) Inventors: Emanuele Morelli, Azzano San Paolo (IT); Dietmar Gentsch, Ratingen (DE); Jacopo Bruni, Caselle Lurani (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/574,862

(22) Filed: Jan. 13, 2022

(65) Prior Publication Data

US 2022/0223361 A1 Jul. 14, 2022

(30) Foreign Application Priority Data

Jan. 14, 2021 (EP) ..... 21151597

(51) Int. Cl.
*H01H 33/664* (2006.01)
*H01H 33/662* (2006.01)
*H01H 33/666* (2006.01)

(52) U.S. Cl.
CPC ..... *H01H 33/664* (2013.01); *H01H 33/662* (2013.01); *H01H 33/666* (2013.01)

(58) Field of Classification Search
CPC .. H01H 33/664; H01H 33/662; H01H 33/666; H01H 33/6661; H01H 33/66; H01H 33/121; H01H 33/122; H01H 33/125–128; H01H 2033/6667; H01H 31/003; H01H 31/28
USPC ..... 218/118, 10, 12, 14, 16, 45, 48, 55, 67, 218/69, 79, 80, 84, 100; 200/15, 16 F, 200/48 KB, 50.38, 50.39
See application file for complete search history.

(56) References Cited

U.S. PATENT DOCUMENTS 7,091,439 B2 * 8/2006 Vaghini ..... H01H 33/125 218/7
7,310,221 B2 * 12/2007 Lammers ..... H01H 33/022 361/647
8,227,721 B2 * 7/2012 Piccoz ..... H01H 33/6661 218/120
8,729,416 B2 * 5/2014 Bullock ..... H01H 33/6662 218/118
9,251,972 B2 * 2/2016 Belloni ..... H01H 33/6661
9,362,061 B2 * 6/2016 Endre ..... H01H 33/125
(Continued)

FOREIGN PATENT DOCUMENTS

DE 102005002139 A1 7/2006

OTHER PUBLICATIONS

Translation of DE102005002139 (Original document published Jul. 27, 2006) (Year: 2006).*

*Primary Examiner* — William A Bolton
(74) *Attorney, Agent, or Firm* — Armstrong Teasdale LLP

(57) ABSTRACT

A switching apparatus is provided herein. The switching apparatus includes: (i) a first pole terminal, a second pole terminal and a ground terminal, (ii) a first contact arrangement including a first fixed contact member and a first movable contact member, (iii) a second contact arrangement including a second fixed contact member and a second movable contact member, (iv) a vacuum chamber wherein the second fixed contact and the second movable contact are enclosed and can be coupled or decoupled, and (v) an electrically conductive coupling lever pivoted on the second movable contact member and reversibly movable about a second rotation axis.

15 Claims, 10 Drawing Sheets

(56) References Cited

U.S. PATENT DOCUMENTS

| | | | | |
|---|---|---|---|---|
| 9,490,084 | B2 * | 11/2016 | Ashtekar | H01H 9/24 |
| 9,659,728 | B2 * | 5/2017 | Martin | H01H 33/662 |
| 9,679,724 | B2 | 6/2017 | Abrahamsen | |
| 2020/0350130 | A1 * | 11/2020 | Kechroud | H01H 33/126 |

* cited by examiner

Transitory Condition C11

Transitory Condition C12

MEDIUM VOLTAGE SWITCHING APPARATUS

CROSS-REFERENCE TO RELATED APPLICATIONS

The present application claims priority to European Patent Application No. 21151597.8, filed on Jan. 14, 2021, the entire contents of which is hereby incorporated by reference in its entirety.

BACKGROUND

The present disclosure relates to a switching apparatus for medium voltage electric systems, and more particularly to a load-break switch for medium voltage electric systems.

Load-break switches are well known in the state of the art.

These switching apparatuses, which are generally used in secondary distribution electric grids, are capable of providing circuit-breaking functionalities (namely breaking and making a current) under specified circuit conditions (typically nominal or overload conditions) as well as providing circuit-disconnecting functionalities (namely grounding a load-side section of an electric circuit).

Most traditional load-break switches of the state of the art have their electric poles immersed in a sulphur hexafluoride ($SF_6$) atmosphere as this insulating gas ensures excellent performances in terms of dielectric insulation between live parts and arc-quenching capabilities when currents are interrupted.

As is known, however, $SF_6$ is a powerful greenhouse gas and its usage is subject to severe restriction measurements for environmental preservation purposes. For this reason, over the years, there has been made a considerable effort to develop and design load-break switches not employing $SF_6$ as an insulating gas.

Some load-break switches have been developed, in which electric poles are immersed in pressurized dry air or in an environment-friendly insulation gas, such as mixtures of oxygen, nitrogen, carbon dioxide and/or fluorinated gases. Unfortunately, the experience has shown that these switching apparatuses generally do not show fully satisfactory performances, particularly in terms of arc-quenching capabilities.

Other currently available load-break switches employ, for each electric pole, different contact arrangements electrically connected in parallel between the pole terminals.

A contact arrangement has electric contacts operating in an atmosphere filled with an environment-friendly insulating gas or air and it is designed for carrying most of the current flowing along the electric pole as well as driving possible switching manoeuvres.

Another contact arrangement, instead, has electric contacts operating in a vacuum atmosphere and it is specifically designed for quenching the electric arcs arising when the current flowing along the electric pole is interrupted.

These switching apparatuses have proven to ensure a relatively low environmental impact while providing, at the same time, high-level performances in terms of dielectric insulation and arc-quenching capabilities. However, until now, they adopt complicated solutions to manage and coordinate the operation of the above-mentioned multiple contact arrangements. Therefore, they still offer poor performances in terms of structural compactness and reliability in operation.

BRIEF DESCRIPTION OF THE DISCLOSURE

The present disclosure provides a switching apparatus for MV electric systems that allows solving or mitigating the above-mentioned technical problems.

More particularly, the present disclosure provides a switching apparatus ensuring high-level performances in terms of dielectric insulation and arc-quenching capabilities during the current breaking process.

The present disclosure also provides a switching apparatus showing high levels of reliability in operation.

The present disclosure also provides a switching apparatus having electric poles with high compactness and structural simplicity.

The present disclosure also provides a switching apparatus that can be easily manufactured at industrial level, at competitive costs with respect to the solutions of the state of the art.

The present disclosure provides a switching apparatus, according to the claims of the present disclosure.

In a general definition, the switching apparatus of the disclosure includes one or more electric poles.

For each electric pole, the switching apparatus includes a first pole terminal, a second pole terminal and a ground terminal. In operation, the first pole terminal can be electrically coupled to a first conductor of an electric line, the second pole terminal can be electrically coupled to a second conductor of the electric line and the ground terminal can be electrically coupled to a grounding conductor.

For each electric pole, the switching apparatus includes a first contact arrangement including a first fixed contact member and a first movable contact member.

The first fixed contact member is electrically connected to the first pole terminal and it includes a first fixed contact.

The first movable contact member is electrically connected to the second pole terminal and it includes a first movable contact.

The first movable contact member is reversibly movable about a corresponding first rotation axis according to a first rotation direction, which is oriented away from the first fixed contact and towards the above-mentioned ground terminal, or according to a second rotation direction, which is opposite to the first rotation direction and therefore oriented away from the ground terminal and towards the first fixed contact.

Since the first movable contact member can be moved about the above-mentioned first rotation axis, the first movable contact can be coupled to or uncoupled from the first fixed contact or can be coupled to or uncoupled from the ground terminal.

For each electric pole, the switching apparatus includes a first contact arrangement including a second fixed contact member and a second movable contact member.

The second fixed contact member is electrically connected to the first pole terminal and includes a second fixed contact.

The second movable contact member includes a second movable contact and is reversibly movable along a corresponding translation axis.

Since the second movable contact member can be moved about the above-mentioned translation axis, the second movable contact can be coupled to or decoupled from the second fixed contact.

For each electric pole, the switching apparatus includes a vacuum chamber, in which the above-mentioned second fixed contact and second movable contact are enclosed and are coupled or decoupled.

For each electric pole, the switching apparatus includes an electrically conductive coupling lever, which is pivoted on the second movable contact member and is reversibly movable about a second rotation axis according to a third rotation direction or according to a fourth rotation direction, opposite to the third rotation direction.

The coupling lever is arranged in such a way to couple with and be actuated by the above-mentioned first movable contact member, when the first movable contact member moves according to the first rotation direction.

The coupling lever connects electrically the above-mentioned second movable contact member with the above-mentioned first movable contact member, when it is coupled to the first movable contact member.

The coupling lever is moved according to the third rotation direction to couple with a fixed mechanical element, when it is actuated by the first movable contact member while this latter is moving according to the first rotation direction.

Due to the mechanical interaction with the fixed mechanical element, the coupling lever exerts on the second movable contact member an actuation force directed to move the second movable contact away from the second fixed contact, when the coupling lever is coupled with the fixed mechanical element and is further actuated by the first movable contact member.

The coupling lever may include:

a first lever portion coupling with and actuated by the first movable contact member when the first movable contact member moves according to the first rotation direction. The first lever portion electrically connects the second movable contact member with the first movable contact member, when coupled to the first movable contact member;

a second lever portion having a cam profile. The second lever portion couples and interacts mechanically with the fixed mechanical element, when the first lever portion is actuated by the first movable contact member and is moved according to the third rotation direction.

The coupling lever may have a reverse L-shaped body, the longer leg of the reverse L-shaped body forming the first lever portion, the shorter leg of the reverse L-shaped body forming the second lever portion.

According to some embodiments of the disclosure, the first lever portion has a free end having a forked shape and coupling with the first fixed contact, when the coupling lever is in a rest portion.

According to other embodiments of the disclosure, the first lever portion has a free end accommodated in a grooved seat of the first fixed contact and couples with the first fixed contact, when the coupling lever is in a rest portion.

BRIEF DESCRIPTION OF THE DRAWINGS

Further characteristics and advantages of the disclosure will emerge from the description of the disclosure and the drawings provided herewith, wherein.

DETAILED DESCRIPTION OF THE DISCLOSURE

With reference to the figures, the present disclosure relates to a switching apparatus 1 for medium voltage electric systems.

For the purpose of the present application, the term "medium voltage" (MV) relates to operating voltages at electric power distribution level, which are higher than 1 kV AC and 1.5 kV DC up to some tens of kV, e.g. up to 72 kV AC and 100 kV DC.

The switching apparatus 1 is particularly adapted to operate as a load-break switch. It is therefore designed for providing circuit-breaking functionalities under specified circuit conditions (nominal or overload conditions) as well as circuit-disconnecting functionalities, in particular grounding a load-side section of an electric circuit.

The switching apparatus 1 includes one or more electric poles 2.

The switching apparatus 1 may be of the multi-phase (e.g. three-phase) type and it includes a plurality (e.g. three) of electric poles 2.

The switching apparatus 1 may include an insulating housing 4, which conveniently defines an internal volume where the electric poles 2 are accommodated.

Figure 1:
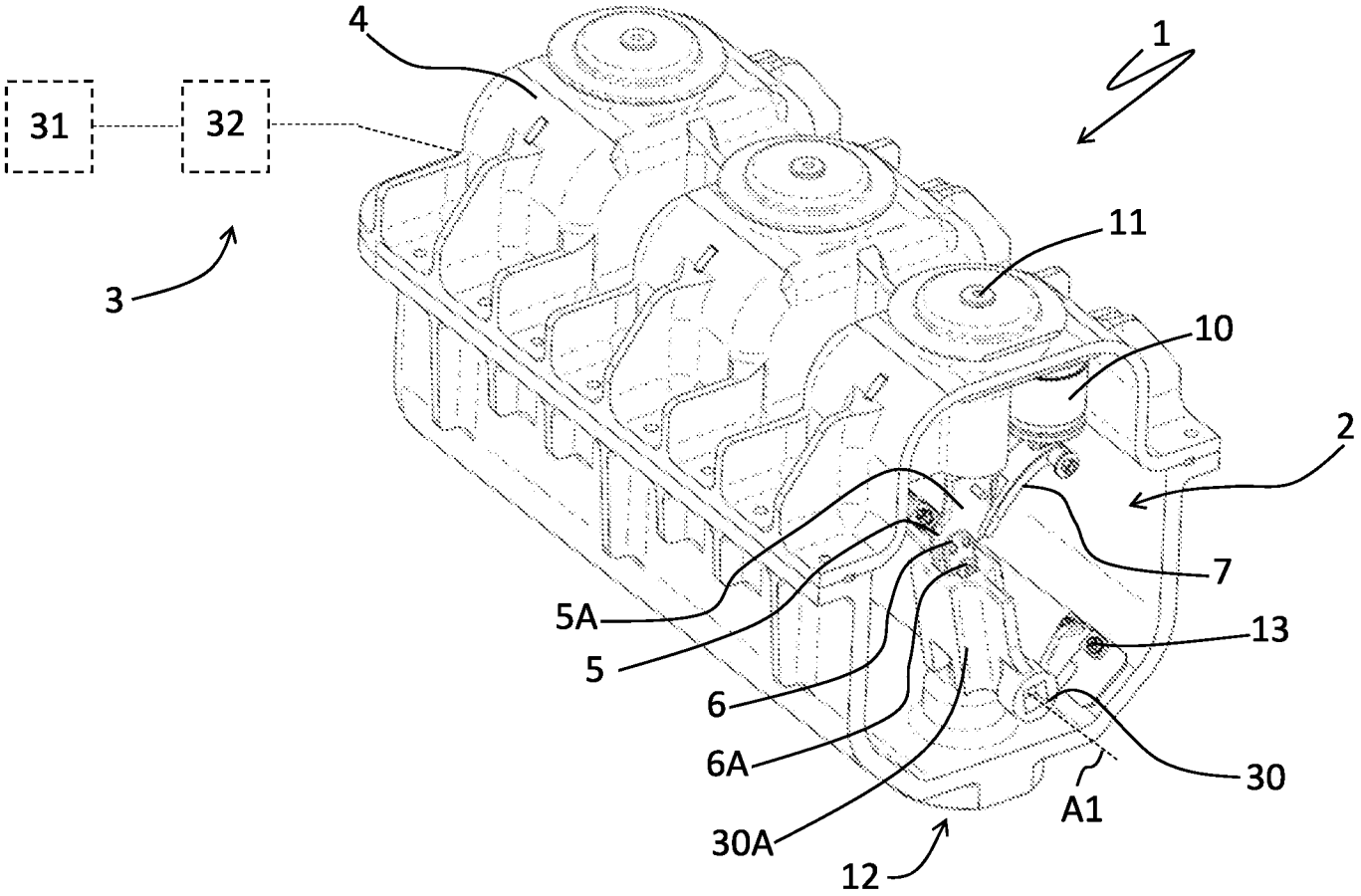
FIGS. 1-4 are schematic views partially showing an embodiment of the switching apparatus, according to the disclosure.

The insulating housing 4 may have an elongated shape (e.g. substantially cylindrical) developing along a a main longitudinal axis (FIG. 1). The electric poles 2 are arranged side by side along corresponding transversal planes perpendicular the main longitudinal axis of the switching apparatus.

In general, the insulating housing 4 of the switching apparatus may be realized according to solutions of known type. Therefore, in the following, it will be described only in relation to the aspects of interest of the disclosure, for the sake of brevity.

Conveniently, the internal volume of the switching apparatus 1 is filled with pressurized dry air or another insulating gas having a low environmental impact, such as mixtures of oxygen, nitrogen, carbon dioxide and/or fluorinated gases.

For each electric pole 2, the switching apparatus 1 includes a first pole terminal 11, a second pole terminal 12 and a ground terminal 13.

The first pole terminal 11 is adapted to be electrically coupled to a first conductor of an electric line (e.g. a phase conductor electrically connected to an equivalent electric power source), the second pole terminal 12 is adapted to be electrically connected to a second conductor of an electric line (e.g. a phase conductor electrically connected to an equivalent electric load) while the ground pole terminal 13 is adapted to be electrically connected to a grounding conductor.

In general, the terminals 11, 12, 13 of each electric pole 2 of the switching apparatus may be realized according to solutions of known type. Therefore, in the following, they will be described only in relation to the aspects of interest of the disclosure, for the sake of brevity.

According to the disclosure, for each electric pole 2, the switching apparatus 1 includes a first contact arrangement 101.

The first contact arrangement 101 includes an electrically conductive first fixed contact member 5A including at least a first fixed contact 5.

The first fixed contact member 5A is at least partially made of an electrically conductive material and it is electrically connected to the first pole terminal 11. As shown in cited figures, the first fixed contact member 5A may be conveniently formed by an elongated piece of conductive material having one end coupled to the first pole terminal 11 and an opposite blade-shaped free end, which forms the first fixed contact 5.

In principle, however, the first fixed contact member 5A may be realized according to other solutions of known type (e.g. according to a multiple-blade configuration including multiple fixed contacts), which are here not described in details for the sake of brevity.

The first contact arrangement 101 includes a first movable contact member 6A including at least a first movable contact 6.

The first movable contact member 6A is at least partially made of an electrically conductive material and it is electrically connected to the second pole terminal 12.

The first movable contact member 6A is reversibly movable (along a given plane of rotation) about a corresponding first rotation axis A1, which is substantially parallel to the main longitudinal axis of the switching apparatus.

The first movable contact member 6A can rotate according to a first rotation direction R1, which is oriented away from the first fixed contact 5 and towards the ground terminal 13, or according to a second rotation direction R2, which is opposite to the first rotation direction R1 and is oriented away from the ground terminal 13 and towards the first fixed contact 5.

Figure 2:
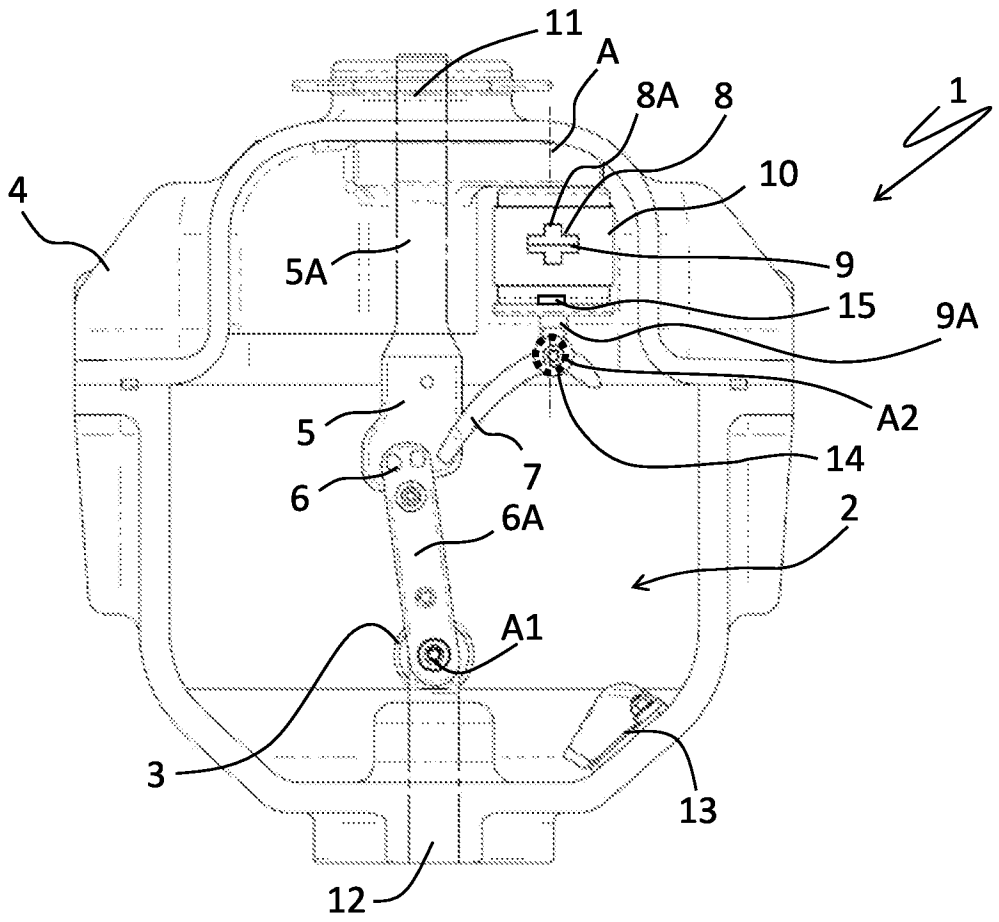

With reference to an observation plane of FIG. 2, the above-mentioned first rotation direction R1 is oriented clockwise while the above-mentioned second rotation direction R2 is oriented counter-clockwise.

As it will better illustrated in the following, the first movable contact member 6A moves according to the first rotation direction R1 during an opening manoeuvre or a disconnecting manoeuvre of the switching apparatus and it moves according to the second rotation direction R2 during a closing manoeuvre or a reconnecting manoeuvre of the switching apparatus.

As the first movable contact member 6A is reversibly movable about the first rotation axis A1, the first movable contact 6 can be coupled to or uncoupled from the first fixed contact 5 or it can be coupled to or uncoupled from the ground terminal 13.

As shown in cited figures, the first movable contact member 6A may be formed by a pair of blades of conductive material. Each blade has an end hinged to the second terminal 12 of the corresponding electric pole at the first rotation axis A1 and an opposite free end forming a movable contact 6. In this way, each movable contact 6 can be coupled to or uncoupled from a corresponding coupling surface of the blade-shaped portion of the first fixed member 5A, which forms the first fixed contact 5.

In principle, however, the first movable contact member 6A may be realized according to other solutions of known type (e.g. according to a single-blade configuration including a single movable contact), which are here not described in details for the sake of brevity.

The switching apparatus 1 may include an actuation assembly 3 providing suitable actuation forces to actuate the movable contact members 6A of the electric poles (FIG. 1).

The actuation assembly 3 may include a motion transmission shaft 30 made of electrically insulating material, which can rotate about the first rotation axis A1 and it is coupled to the first movable contact members 6A of the electric poles 2.

The motion transmission shaft 30 thus provides rotational mechanical forces to actuate the first movable contact members 6A during the manoeuvres of the switching apparatus.

As shown in the cited figures, the motion transmission shaft 30 may include suitable coupling seats 30A, in which the first movable contact members 6A are accommodated and solidly coupled to the motion transmission shaft.

The actuation assembly 3 may include an actuator 31 coupled to the transmission shaft 3 through a suitable kinematic chain 32. The actuator 31 may be, for example, a mechanical actuator, an electric motor or an electromagnetic actuator.

In general, the actuation assembly 3 of the switching apparatus may be realized according to solutions of known type. Therefore, in the following, it will be described only in relation to the aspects of interest of the disclosure, for the sake of brevity.

According to the disclosure, for each electric pole 2, the switching apparatus 1 includes a second contact arrangement 102.

The second contact arrangement 102 includes a second fixed contact member 8A including at least a second fixed contact 8.

The second fixed contact member 8A is at least partially made of an electrically conductive material and it is electrically connected to the first pole terminal 11. The second fixed contact member 8A may be positioned in parallel to the first fixed contact member 5A along a same reference plane (e.g. the plane of rotation of the first movable contact member 6A).

As shown in cited figures, the second fixed contact member 8A may be formed by an elongated piece of conductive material having one end coupled to the first pole terminal 11 and an opposite free end forming the second fixed contact 8.

In principle, however, the second fixed contact member 8A may be realized according to other solutions of known type (e.g. a multi-blade configuration), which are here not described in details for the sake of brevity.

The second contact arrangement 102 includes a second movable contact member 9A including at least a second movable contact 9.

The second movable contact member 9A is reversibly movable along a corresponding translation axis A, which may be parallel to the first fixed contact member 5A along a same reference plane (e.g. the plane of rotation of the first movable contact member 6A) and perpendicular to the rotation axis A1 of the first movable contact member 6A.

As the second movable contact member 8A is reversibly movable about the displacement axis A, the second movable contact 9 can be coupled to or uncoupled from the second fixed contact 8.

As shown in cited figures, the second movable contact member 9A may be formed by an elongated piece of conductive material having one end coupled to a further mechanical element 7 and an opposite free end forming the second mobile contact 9.

In principle, however, the second mobile contact member 9A may be realized according to other solutions of known type (e.g. a multi-blade configuration), which are here not described in details for the sake of brevity.

According to the disclosure, for each electric pole 2, the switching apparatus 1 includes a vacuum chamber 10, in which a vacuum atmosphere is present.

Conveniently, the second fixed contact 8 and the second movable contact 9 are enclosed in the vacuum chamber 10 and they are mutually coupled or decoupled inside the vacuum chamber, therefore being permanently immersed in a vacuum atmosphere.

The vacuum chamber 10 may be realized according to solutions of known type. Therefore, in the following, it will be described only in relation to the aspects of interest of the disclosure, for the sake of brevity.

According to the disclosure, for each electric pole 2, the switching apparatus 1 includes a coupling lever 7 at least partially made of conductive material.

The coupling lever 7 is pivoted on the second movable contact member 9A and it is reversibly movable about a second rotation axis A2, according to a third rotation direction R3 or a fourth rotation direction R4, opposite to the third rotation direction.

With reference to an observation plane of FIG. 2, the above-mentioned third rotation direction R3 is oriented counter-clockwise while the above-mentioned fourth rotation direction R4 is oriented clockwise.

The coupling lever 7 couples with the first movable contact member 6A, when this latter moves according to the first rotation direction R1 (starting from a coupled position with the first fixed contact member 5), during an opening manoeuvre of the switching apparatus.

When it is coupled to the first movable contact member 6A, the coupling lever 7 electrically connects the first movable contact member with the second movable contact member 9A (and therefore the first movable contact 6 with the second movable contact 9).

When it is actuated by the first movable contact member 6A, the coupling lever 7 is moved according to the third rotation direction R3 and it forced to couple with a fixed mechanical element 10.

Due to the mechanical interaction with the fixed mechanical element 10, the coupling lever 7 exerts an actuation force on the second movable contact member 9A, when the coupling lever couples with the fixed mechanical element and is further actuated by the first movable contact member 6A. The actuation force provided by the coupling lever 7 is directed to move the second movable contact 9 away from the second fixed contact 8 (translation direction D1-FIG. 7).

As shown in the cited figures, the above-mentioned fixed mechanical member may be the vacuum chamber 10 (or better the external enclosure thereof). However, in principle, the above-mentioned fixed mechanical member may be another fixed element or supporting part of the electric pole.

As it is better illustrated in the following, the coupling lever 7 is actuated by the first movable contact member 6A also when this latter moves according to the second rotation direction R2, during a closing manoeuvre of the switching apparatus. However, in this case, the coupling lever 7 does not interact with any fixed mechanical support and it does not exert any actuation force on the second movable contact member 9A.

As it is better illustrated in the following, the coupling lever 7 is not actuated by the first movable contact member 6A during a disconnecting manoeuvre or a reconnecting manoeuvre of the switching apparatus.

When it is not actuated by the first movable contact member 6A, the coupling lever 7 takes a suitable rest position, at which it is coupled to the first fixed contact member 5A.

As it is better illustrated in the following, the coupling lever 7 remains coupled to the first fixed contact member 5A also when it is actuated by first movable contact member 6A while this latter moves according to the second rotation direction R2, during a closing manoeuvre of the switching apparatus.

When it is coupled to the first fixed contact member 5A, the coupling lever 7 electrically connects the first fixed contact member with the second movable contact member 9A (and therefore the first fixed contact 5 with the second movable contact 9).

The coupling lever 7 may include a first lever portion 71 that couples with and is actuated by the first movable contact member 6A when this latter moves according to the first rotation direction R1, during an opening manoeuvre of the switching apparatus.

The coupling lever 7 is electrically conductive in such a way to connect electrically the second movable contact member 9A with the first movable contact member 6A, when it is coupled to the first movable contact member.

The coupling lever 7 may include a second lever portion 72 having a cam profile. Thanks to a suitable rotation movement (third rotation direction R3) of the coupling lever 7, the second lever portion 72 couples and interacts mechanically with the fixed mechanical element 10, when the first lever portion 71 is actuated by the first movable contact member 6A and this latter moves according to the first rotation direction R1, during an opening manoeuvre of the switching apparatus.

The rotation axis A2 of the coupling lever 7 may be located in an intermediate position between the first and second lever portions 71, 72.

The first lever portion 71 may couple with and is actuated by the first movable contact member 6A when this latter moves according to the second rotation direction R2, during a closing manoeuvre of the switching apparatus. However, in this case, the second lever portion 72 moves freely without coupling with any fixed mechanical element.

The first lever portion 71 may be coupled to the first fixed contact member 5 when the coupling lever 7 is in a rest position.

According to some embodiments of the disclosure (FIGS. 1-10), the first lever portion 71 has a free end 711 having a forked shape for coupling with the first fixed contact 5 (more particularly with the blade-shaped free end of the first fixed movable contact member 5A, which forms the first fixed contact 5).

Figure 12:
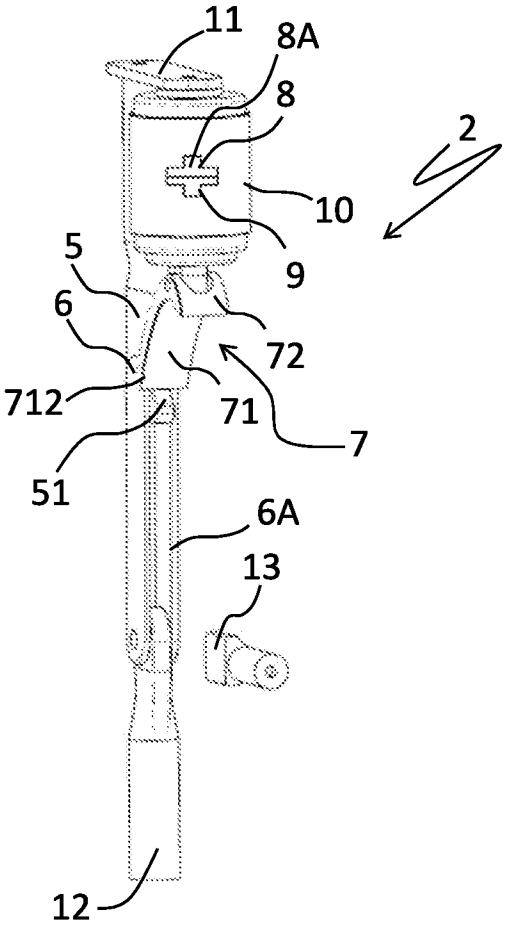
FIGS. 11-12 are schematic views partially showing a variant embodiment of the switching apparatus, according to the disclosure.

According to other embodiments of the disclosure (FIGS. 11-12), the first lever portion 71 has a free end 711 for insertion in a grooved seat 51 of the first fixed contact 5 (more particularly of the blade-shaped free end of the first fixed movable contact member 5A, which forms the first fixed contact 5) and coupling with the first fixed contact.

It is evident that both the above-illustrated solutions allow suitably positioning the coupling lever 7 with respect to the first fixed contact member 5A and the first movable contact member 6A, when the coupling lever is in a rest position.

The coupling lever 7 may be made by a shaped piece of conductive material. As an alternative, the coupling lever 7 may be partially made of electrically insulating material provided that a conductive path is ensured at least between the coupling point A2 with the second movable contact member 9A and the free end 711, 712 of the first lever portion 71.

According to embodiments of the disclosure (shown in the cited figures), the coupling lever 7 may have a reverse L-shaped body. The longer leg of such a reverse L-shaped body forms the above-mentioned first lever portion 71 while the shorter leg of such a reverse L-shaped body forms the above-mentioned second lever portion 72.

The rotation axis A2 of the coupling lever 7 may be positioned at the corner between the longer leg and the shorter leg of such a reverse L-shaped body.

The switching apparatus 1 may include, for each electric pole 2, first elastic means 14 operatively coupled to the coupling lever 7 (FIG. 2).

The first elastic means 14 are arranged in such a way to exert a force opposing to a rotation movement of the coupling lever 7 according to the third rotation direction R3, during an opening manoeuvre of the switching apparatus.

The first elastic means 14 thus cause the return of the coupling lever 7 in a rest position after having rotated according to the third rotation direction R3 during an opening manoeuvre of the switching apparatus, particularly when the coupling lever decouples from the first movable contact member 6A.

The first elastic means 14 may be formed by a torsion spring having opposite ends operatively coupled to the second movable contact member 9A and to the coupling lever 7, at the second rotation axis A2 of this latter.

In principle, however, the first elastic means 14 may be arranged according to other solutions of known type, which are here not described for the sake of brevity.

The switching apparatus 1 may include, for each electric pole 2, second elastic means 15 operatively coupled to the second movable contact member 9A (FIG. 2).

The second elastic means 15 are arranged in such a way to exert a force opposing to a movement of the second movable contact 9, which is oriented away from the second fixed contact 8 (first translation direction D1), when the second movable contact member 8A is actuated by the coupling lever 7.

The second elastic means 15 may be formed by a linear spring having opposite ends operatively coupled to the second movable contact member 9A and to the enclosure of the vacuum chamber 10.

In principle, however, the second elastic means 15 may be arranged according to other solutions of known type, which are here not described for the sake of brevity.

Figure 4:
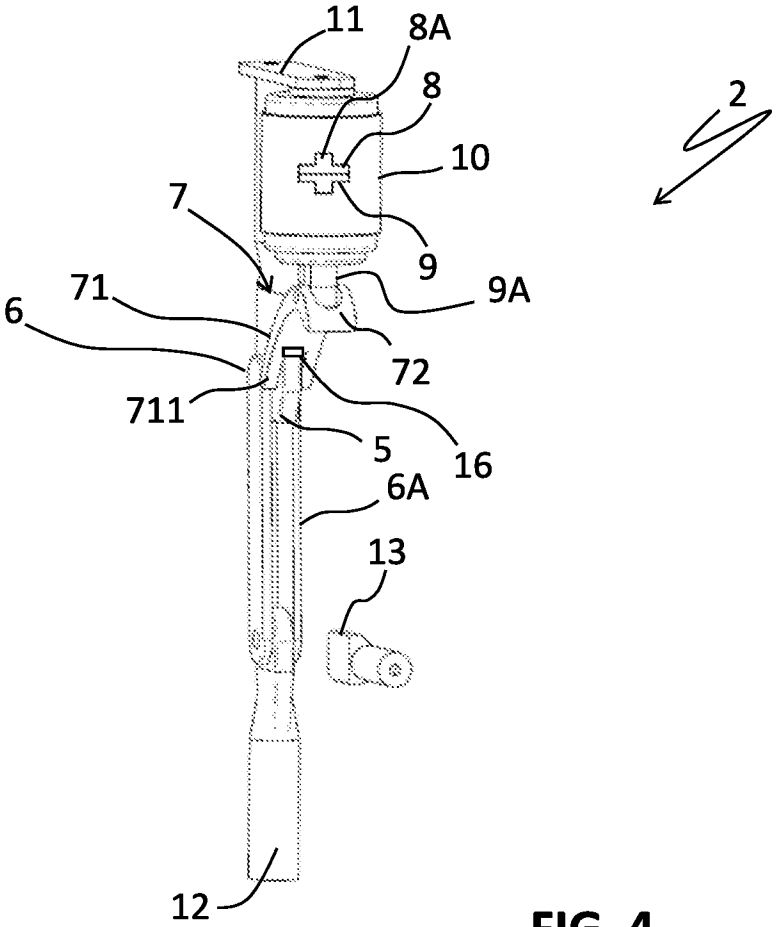
Figure 3:
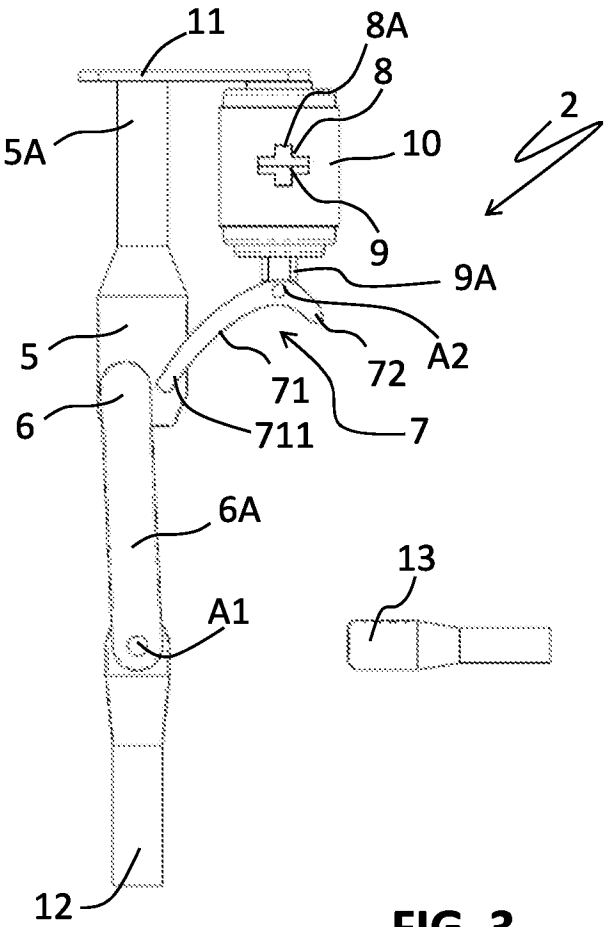
Figure 11:
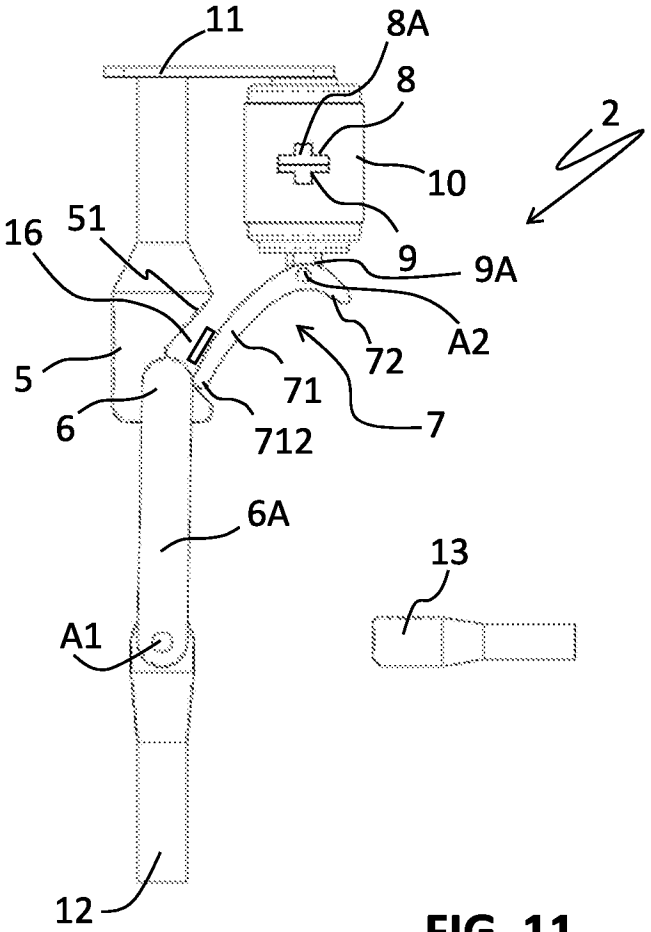

The switching apparatus 1 may include, for each electric pole 2, third elastic means 16 adapted to operatively couple with the coupling lever 7 (FIGS. 4 and 11).

The third elastic means 16 are arranged in such a way to exert a force opposing to a rotation movement R4 of the coupling lever 7, when this latter is actuated by the first movable contact member 6A, during a closing manoeuvre of the switching apparatus.

The third elastic means 16 thus cause the return of the coupling lever 7 in a rest position after having rotated according to the fourth rotation direction R4, when the coupling lever decouples from the first movable contact member 6A.

The third elastic means 16 may be formed by a piece of elastic material (e.g. rubber) coupled to the coupling lever 7. Such a piece of elastic material is compressed by the fixed contact 5 when the coupling lever 7 is moved away from a rest position according to a fourth rotation direction R4, upon actuation by the first movable contact member 6A.

In principle, however, the third elastic means 16 may be arranged according to other solutions of known type, which are here not described for the sake of brevity. For example, they may be formed by a piece of elastic material (e.g. rubber) coupled to the first fixed contact member 5A or another fixed support.

According to the disclosure, in operation, the switching apparatus 1 is capable of switching in three different operating states.

In particular, the switching apparatus 1 can switch in:

a closed state, in which each electric pole 2 has the first and second pole terminals 11, 12 electrically connected one to another and electrically disconnected from the ground terminal 13. When the switching apparatus is in a closed state, a current can flow along each electric pole 2 between the corresponding first and second pole terminals 11, 12; or an open state, in which each electric pole 2 has the first and second pole terminals 11, 12 and the ground terminal 13 electrically disconnected one from another. When the switching apparatus is in an open state, no currents can flow along the electric poles 2; or a grounded state, in which each electric pole 2 has the first and second pole terminals 11, 12 electrically disconnected one from another and the second pole terminal 12 and the ground terminal 13 electrically connected one to another. When the switching apparatus is in a grounded state, no currents can flow along the electric poles 2. However, the second pole terminal 12 of each electric pole (and therefore the second line conductor connected thereto) is put at a ground voltage.

According to the disclosure, in operation, the switching apparatus 1 is capable of carrying out different type of manoeuvres, each corresponding to a given transition among the above-mentioned operating states.

In particular, the switching apparatus 1 is capable of carrying out:

an opening manoeuvre when it switches from a closed state to an open state; or a closing manoeuvre when it switches from an open state to a closed state; or a disconnecting manoeuvre when it switches from an open state to a grounded state; or a reconnecting manoeuvre when it switches from a grounded state to an open state.

Obviously, the switching apparatus 1 can switch from a closed state to a grounded state by carrying out an opening manoeuvre and subsequently a disconnecting manoeuvre.

Similarly, the switching apparatus 1 can switch from a grounded state to a closed state by carrying out a reconnecting manoeuvre and subsequently a closing opening manoeuvre.

In order to carry out the above-mentioned manoeuvres of the switching apparatus, the above-mentioned motion transmission shaft 30 suitably drives the first movable contact member 6A of each electric pole according to the above-mentioned first rotation direction R1 or second rotation direction R2.

In general, upon actuation by the motion transmission shaft 52, the first movable contact member 6A of each electric pole is reversibly movable between a first end-of-run position $P_A$, which corresponds to a closed state of the switching apparatus, and a second end-of-run position $P_C$, which corresponds to a grounded state of the switching apparatus.

Conveniently, the first motion transmission member passes through an intermediate position $P_B$, which corresponds to an open state of the switching apparatus, when it moves between the first and second end-of-run positions $P_A$, $P_C$ (FIGS. 5-10).

The operation of the switching apparatus 1 for each electric pole 2 is now described in more details.

The operation of the switching apparatus 1 for each electric pole 2 is now described in more details.

Closed State of the Switching Apparatus

Figure 5:
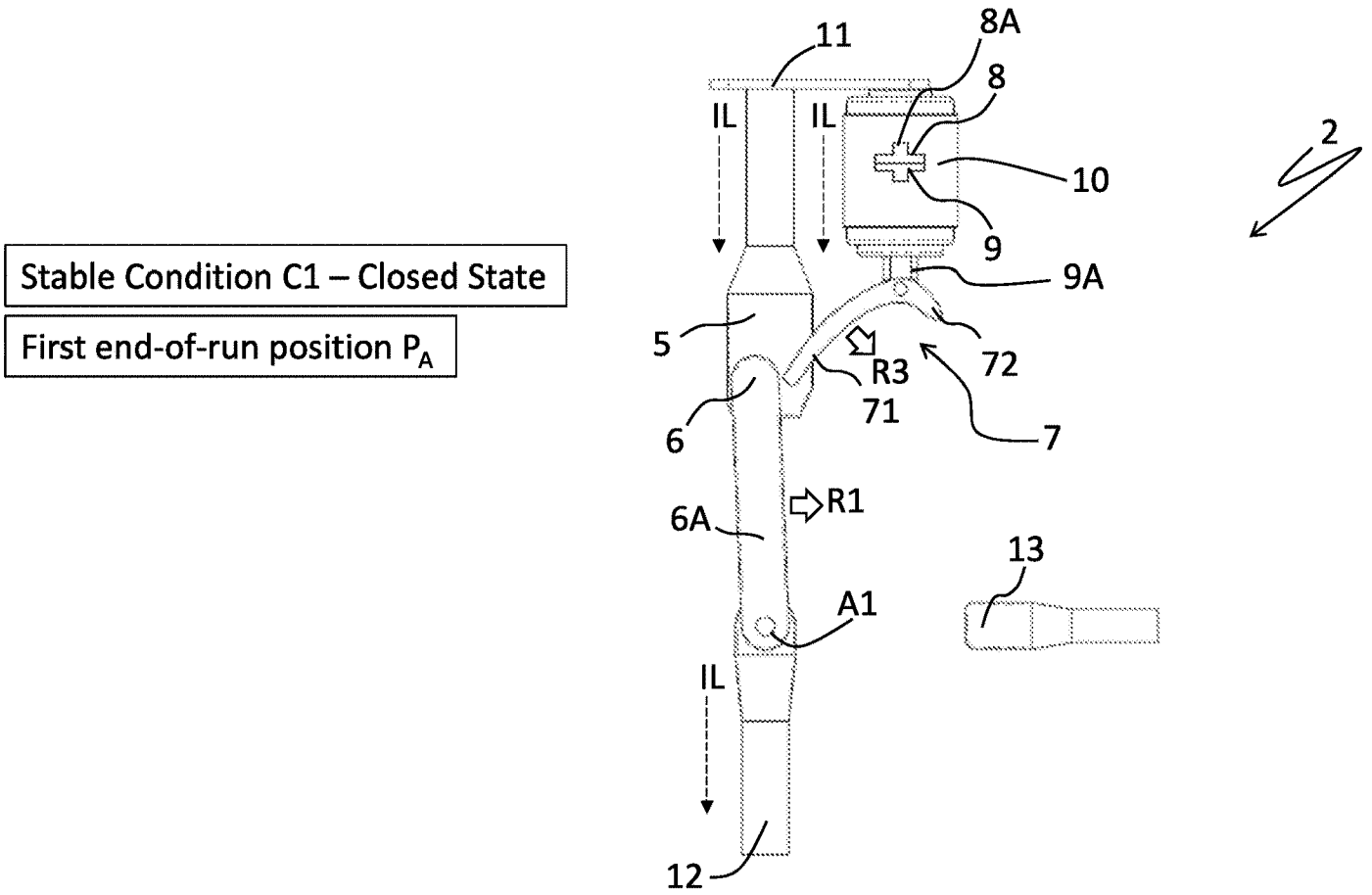
FIGS. 5-10 are schematic views to illustrate operation of the switching apparatus of FIGS. 1-4.
Figure 6:
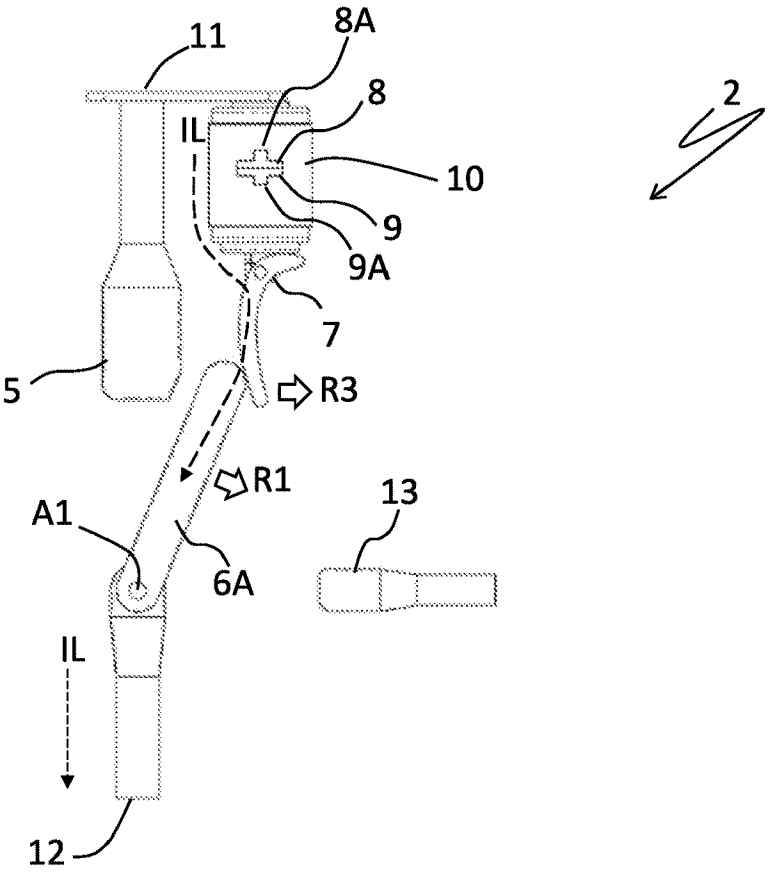

When the switching apparatus is in a closed state, each electric pole 2 is in the operating condition (first stable condition C1) illustrated in FIG. 5.

In this situation, each electric pole 2 has:

the first movable contact member 6A in the first end-of-run position $P_A$; and the first movable contact 6 coupled to the first fixed contact 5; and the second movable contact 9 coupled to the second fixed contact 8.

The coupling lever 7 is in a rest position.

In particular, the coupling lever 7 (namely the first lever portion 71) is:

coupled to the first fixed contact member 5A; and decoupled from the first movable contact member 6A.

In this case, the coupling lever 7 electrically connects the first fixed contact member 5A with the second movable contact member 9A (and therefore the first fixed contact 5 with the second movable contact 9).

The coupling lever 7 (namely the first lever portion 71) is positioned in such a way to be actuated by the first movable contact member 6A when this latter moves away from the first fixed contact member 5A by rotating along the first rotation direction R1.

In practice, the coupling lever 7 (namely the first lever portion 71) is positioned along the motion trajectory of the first movable contact member 6A when this latter away from the first end-of-run position $P_A$. In this way, the coupling lever 7 (namely the first lever portion 71) coupled with the first movable contact member 6A, when this latter starts moving according to the first rotation direction R1 (during an opening manoeuvre of the switching apparatus).

When an electric pole 2 is in the first stable condition C1, a current IL can flow between the first and second pole terminals 11, 12 passing through the first and second contact arrangements 101, 102 in parallel. Obviously, most of the current will flow along the first contact arrangement 101 as this latter has a lower equivalent resistance due to the larger size of the contact members 5A, 6A with respect to the contact members 8A, 9A.

Open State of the Switching Apparatus

Figure 8:
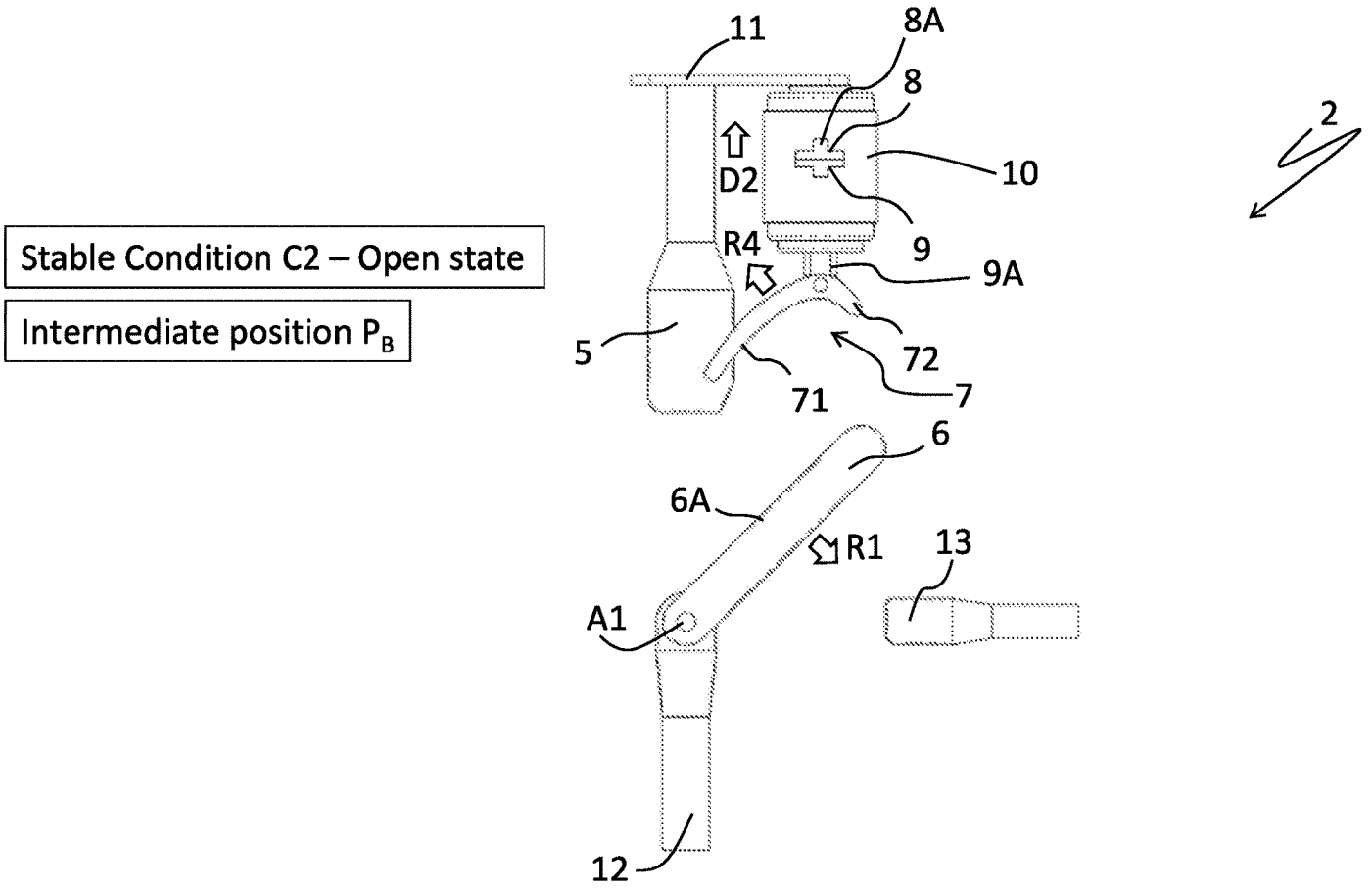

When the switching apparatus is in an open state, each electric pole 2 is in the condition (second stable condition C2) illustrated in FIG. 8.

In this situation, each electric pole 2 has:

the first movable contact member 6A in the intermediate position $P_B$; and the first movable contact 6 decoupled from the first fixed contact 5; and the second movable contact 9 coupled to the second fixed contact 8.

The coupling lever 7 is in a rest position.

In particular, the coupling lever 7 (namely the first lever portion 71) is:

coupled to the first fixed contact member 5A; and decoupled from the first movable contact member 6A.

The first movable contact member 6A is decoupled from other elements of the corresponding electric pole.

When an electric pole 2 is in the second stable condition C2, no current flows along it between the first and second pole terminals 11, 12.

Grounded State of the Switching Apparatus

Figure 9:
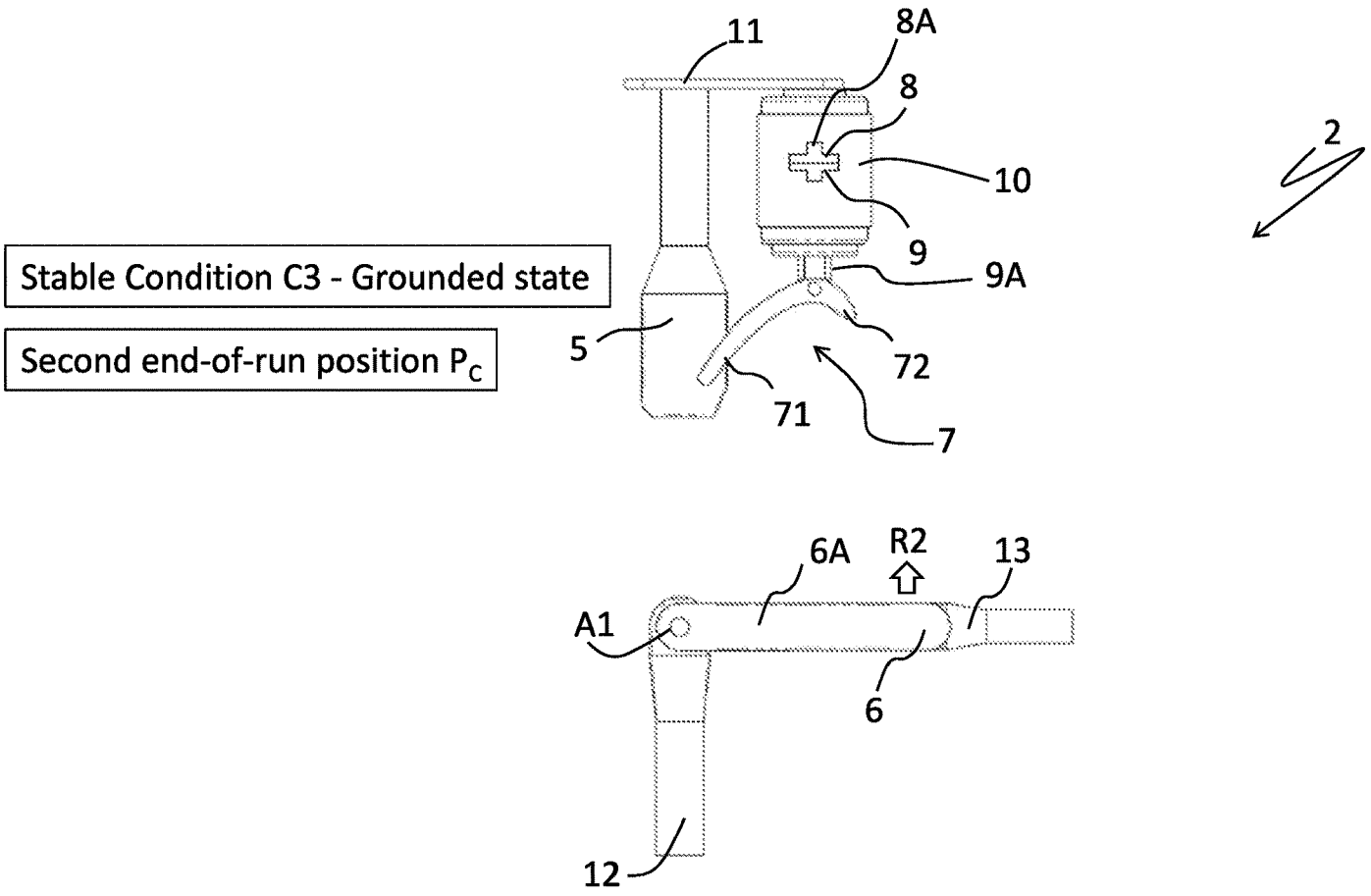

When the switching apparatus is in a grounded state, each electric pole 2 is in the condition (third stable condition C3) illustrated in FIG. 9.

In this situation, each electric pole 2 has:

the first movable contact member 6A in the second end-of-run position $P_B$; and the first movable contact 6 decoupled from the first fixed contact 5 and coupled to the ground terminal 13; and the second movable contact 9 coupled to the second fixed contact 8.

The coupling lever 7 is in a rest position.

In particular, the coupling lever 7 (namely the first lever portion 71) is:

coupled to the first fixed contact member 5A; and decoupled from the first movable contact member 6A.

The first movable contact member 6A electrically connects the pole terminal 12 with the ground terminal 13.

When an electric pole 2 is in the third stable condition C3, no current flows along it between the first and second pole terminals 11, 12 and the second pole terminal 12 is put at a ground voltage.

Opening Manoeuvre

The switching apparatus 1 carries out an opening manoeuvre, when it switches from the closed state to the open state.

Initially, each electric pole 2 is therefore in the above-illustrated first stable condition C1 (FIG. 5).

During an opening manoeuvre of the switching apparatus, each first movable contact member 6A moves, according to the first rotation direction R1, between the first end-of-run position $P_A$ and the intermediate position $P_B$. Each first movable contact member 6A thus moves away from the corresponding first fixed contact member 5A.

When the first movable contact member 6A starts moving according to the first rotation direction R1, the first movable contact 6 decouples from the first fixed contact 5.

Since the coupling lever 7 (namely the first lever portion 71) is positioned along its motion trajectory towards the intermediate position $P_B$, the first movable contact member 6A engages the coupling lever 7 (namely the first lever portion 71).

The first movable contact member 6A thus couples with and actuates the coupling lever 7 (namely the first lever portion 71) and it moves this latter away from a rest position, according to the third rotation direction R3.

It is evident that, at this stage of the opening manoeuvre, upon an initial movement of the first movable contact member 6A, each electric pole 2 has switched from the first stable condition C1 (FIG. 5) to a first transitory condition C11 (FIG. 6), in which:

the first movable contact 6 is decoupled from the first fixed contact 5; and the second movable contact 9 is coupled to the second fixed contact 8; and the coupling lever 7 is decoupled from the first fixed contact member 5A and it is coupled to the movable contact member 6A.

The coupling lever 7 electrically connects the first movable contact member 6A with the second movable contact member 9A (and therefore the first movable contact 6 with the second movable contact 9).

When an electric pole 2 is in the first transitory condition C11, the current IL, which initially flows along the electric pole, is fully deviated through the second contact arrangement 102 as no current can flow through the first contact arrangement 101. Since a conductive path between the pole terminals 11, 12 is still ensured, no electric arcs arise between the first fixed contact 5 and the first movable contact 6 under separation.

Figure 7:
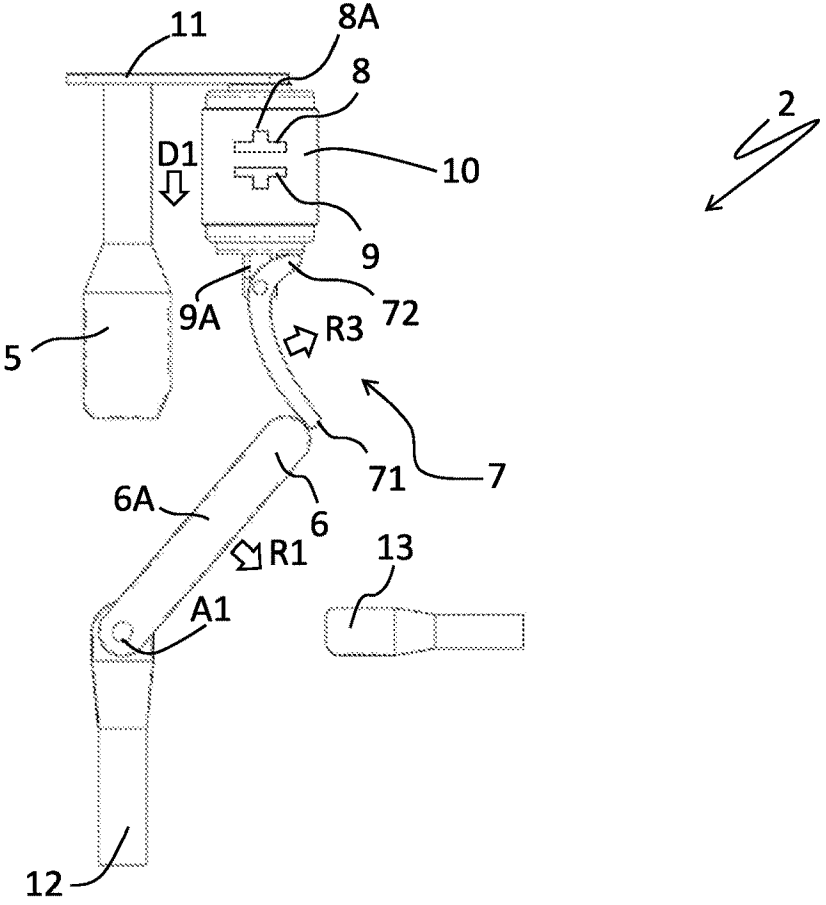

Upon a further movement towards the intermediate position $P_B$, according to the first rotation direction R1, the first movable contact member 6A moves the coupling lever 7 (namely the second lever portion 72) to a coupled position with the fixed mechanical element 10 (FIG. 7). The coupling lever 7 is thus forced to interact mechanically with the fixed mechanical element 10.

As it is actuated by the first movable contact member 6A and it has the second lever portion 72 with a cam profile, the coupling lever 7 exerts on the second movable contact member 9A an actuation force directed to move the second movable contact member 9A away from the second fixed contact member 8A (first translation direction D1). In this way, the coupling lever 7 causes the second movable contact 9 to decouple from the second fixed contact 8.

The separation of the electric contacts 8, 9 causes the rising of electric arcs between the electric contacts. However, since the electric contacts 8, 9 are immersed in a vacuum atmosphere, such electric arcs can be quenched efficiently thereby quickly leading to the interruption of the current IL flowing along the electric pole.

It is evident that, at this stage of the opening manoeuvre, each electric pole 2 has switched from the first transitory condition C11 to a second transitory condition C12 (FIG. 7), in which:

- the first movable contact 6 is decoupled from the first fixed contact 5; and
- the second movable contact 9 is decoupled from the second fixed contact 8; and
- the coupling lever 7 is coupled to the movable contact member 6A.

When an electric pole 2 is in the second transitory condition C12, the current IL, which initially flows along the electric pole, is interrupted due to the separation of the electric contacts 8, 9 located within the vacuum chamber 10.

Upon a further movement towards the intermediate position $P_B$, according to the first rotation direction R1, the first movable contact member 6A decouples from the coupling lever 7.

Due to an actuation force exerted by the first elastic means 14, which are configured to oppose any movement of the coupling lever 7 according to the third rotation direction R3, the coupling lever 7 returns in a rest position by moving back according to the fourth rotation direction R4 (FIG. 8). The coupling lever 7 (namely the first lever portion 71) thus couples again with the first fixed contact member 5A (namely the fixed contact 5).

Similarly, due to an actuation force exerted by the second elastic means 15, which are configured to oppose any movement of the second movable contact member 9A away from the second fixed contact member 8A, the second movable contact member 9A moves back towards the second fixed contact member 8A (second translation direction D2) thereby causing the second movable contact 9 to couple again with the fixed contact 8 (FIG. 8).

In the meanwhile, the first movable contact member 6A reaches the intermediate position $P_B$.

It is evident that, at this stage of the opening manoeuvre, each electric pole 2 has switched from the second transitory condition C12 to the second stable condition C2 (FIG. 8), which corresponds to an open state of the switching apparatus.

Closing Manoeuvre

The switching apparatus 1 carries out a closing manoeuvre, when it switches from the open state to the close state.

Before carrying out a closing manoeuvre, the switching apparatus may have carried a reconnecting manoeuvre as described above in order to switch in an open state.

Initially, each electric pole 2 is therefore in the above-illustrated second stable condition C2 (FIG. 8).

Figure 10:
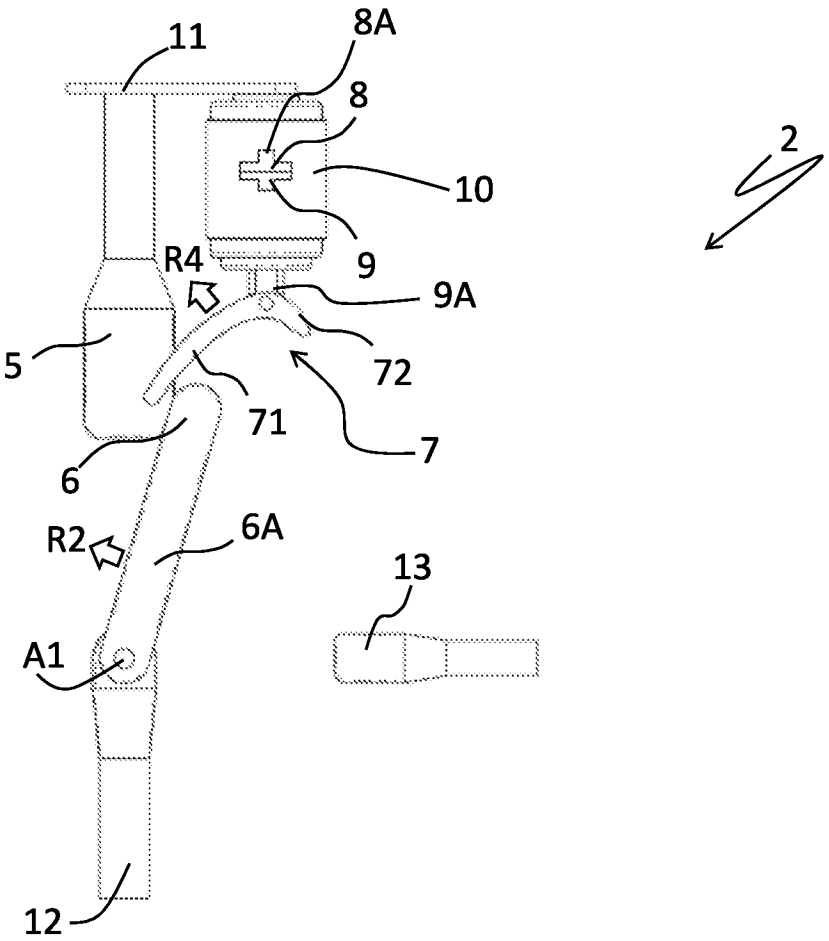

During a closing manoeuvre of the switching apparatus, each first movable contact member 6A moves, according to the second rotation direction R2, between the intermediate position $P_B$ and the first end-of-run position $P_A$. Each first movable contact member 6A thus moves towards the corresponding first fixed contact member 5A (FIG. 10).

Thanks to the particular design of the coupling arrangement between the coupling lever 7 and the first fixed contact 5 (which has been illustrated above), during such movement towards the first end-of-run position $P_A$, upon an initial movement according to the second rotation direction R2, the first movable contact member 6A reaches the first fixed contact member 5A before reaching the coupling lever 7 (namely the first lever portion 71). In this way, the first fixed contact 5 couples with the first movable contact 6 before the first movable contact member 6A engages the coupling lever 7.

Upon a further movement towards the first end-of-run position $P_A$, according to the second rotation direction R2 (the first movable contact 6 remains coupled to the first fixed contact 5), the first movable contact member 6A engages the coupling lever 7, thereby coupling with and actuating this latter.

The coupling lever 7 (namely the first lever portion 71) is moved away from the rest position (while remaining coupled to the first fixed contact 5), according to the fourth rotation direction R4.

Upon a further movement towards the first end-of-run position $P_A$, according to the second rotation direction R2 (the first movable contact 6 remains coupled to the first fixed contact 5), the first movable contact member 6A passes over the coupling lever 7 (namely the first lever portion 71) and it decouples from the coupling lever.

Due to an actuation force exerted by the third elastic means 16, which are configured to oppose any movement of the coupling lever 7 according to the fourth rotation direction R4 (when the coupling lever is coupled with first fixed contact 5), the coupling lever 7 returns in a rest position by moving back according to the third rotation direction R3.

In the meanwhile, the first movable contact member 6A reaches the first end-of-run position $P_A$.

Disconnecting Manoeuvre

The switching apparatus 1 carries out a disconnecting manoeuvre, when it switches from an open state to a grounded state.

Obviously, before carrying out a disconnecting manoeuvre, the switching apparatus has to carry out an opening manoeuvre as described above in order to switch in an open state.

Initially, each electric pole 2 is therefore in the above-illustrated second stable condition C2 (FIG. 8).

During a disconnecting manoeuvre of the switching apparatus, each first movable contact member 6A moves, according to the first rotation direction R1, between the intermediate position $P_B$ and the second end-of-run position $P_C$. Each first movable contact member 6A thus moves towards the corresponding ground terminal (FIG. 9).

The first movable contact member 6A couples with the ground terminal 13, when it reaches the second end-of-run position $P_C$. In this way, the first movable contact member 6A causes the first movable contact 6 to couple with the ground terminal 13.

In this situation, the first movable contact member 6A electrically connects the second pole terminal 12 with the ground terminal 13. The second pole terminal 12 is therefore put at a ground voltage.

It is evidenced that the coupling lever 7 remains in its rest position when the switching apparatus carries out a disconnecting manoeuvre.

Reconnecting Manoeuvre

The switching apparatus 1 carries out a reconnecting manoeuvre, when it switches from a grounded state to an open state.

Initially, each electric pole 2 is therefore in the above-illustrated third stable condition C3 (FIG. 9).

During a reconnecting manoeuvre of the switching apparatus, each first movable contact member 6A moves, according to the second rotation direction R2, between the second end-of-run position $P_C$ and the intermediate position $P_B$. Each first movable contact member 6A thus moves away from the corresponding ground terminal (FIG. 9).

In this way, the first movable contact member 6A causes the first movable contact 6 to decouple from the ground terminal 13.

The first movable contact member 6A does not electrically connect the second pole terminal 12 with the ground terminal 13 anymore. The second pole terminal 12 is therefore at a floating voltage.

It is evidenced that, as for the grounding manoeuvre, the coupling lever 7 is not involved at all when the switching apparatus carries out a reconnecting manoeuvre.

Obviously, the switching apparatus has to carry out a closing manoeuvre as described above in order to return in a closing state.

The switching apparatus, according to the disclosure, provides remarkable advantages with respect to the known apparatuses of the state of the art.

The switching apparatus of the disclosure includes, for each electric pole, with a simple lever arrangement, which allows the first movable contact member 6A to drive the separation of the second movable contact 9 from the second fixed contact 8 depending on the position reached during an opening manoeuvre of the switching apparatus.

In this way, the breaking process of the current flowing along each electric pole can be made to occur at level of the electric contacts 8, 9 that are accommodated in the vacuum chamber 10. Possible electric arcs, which derive from the interruption of a current flowing along each electric pole, therefore form in a vacuum atmosphere only, which allows improving their quenching process.

The circumstance that the coupling lever 7 is directly pivoted on the second movable contact member 9A remarkably simplifies the overall structure of the electric poles 2 and it simplifies the synchronization between the movement of the second movable contact 9 and the movement of the first movable contact member 6A, during an opening manoeuvre of the switching apparatus.

As illustrated above, during a closing manoeuvre of the switching apparatus, the first movable contact member 6A reaches the first fixed contact member 5A (thereby causing the first movable contact 6 to couple with the first fixed contact 5) before engaging the coupling lever 7. Thus, there is no relevant current passage along the coupling lever 7 (and so the second contact arrangement 102). Most of the current. In fact, naturally passes through the first movable contact member 6A and the first fixed contact member 5A when the first movable contact 6 couples with the first fixed contact 5 ("making current" process).

In this condition the second contact arrangement 102 has not to carry a possible short circuit current or an overload current or, more simply, the nominal current. This solution is quite advantageous as it allows designing a more compact vacuum chamber 10, which allows obtaining a further size and cost reduction for the overall switching apparatus.

The switching apparatus of the disclosure has electric poles with a very compact, simple and robust structure with relevant benefits in terms of size optimization.

The switching apparatus, according to the disclosure, ensures high-level performances in terms of dielectric insulation and arc-quenching capabilities during the current breaking process and, at the same time, it is characterised by high levels of reliability for the intended applications.

The switching apparatus, according to the disclosure, is of relatively easy and cheap industrial production and installation on the field.

The invention claimed is:

1. A switching apparatus for medium voltage electric systems, switching apparatus comprising one or more electric poles, wherein, for each electric pole, switching apparatus comprises:

a first pole terminal, a second pole terminal, and a ground terminal, first pole terminal electrically couplable with a first conductor of an electric line, second pole terminal electrically couplable to a second conductor of the electric line, and ground terminal electrically couplable to a grounding conductor;

a first contact arrangement including a first fixed contact member and a first movable contact member, the first fixed contact member electrically connected to first pole terminal and including a first fixed contact, the first movable contact member electrically connected to second pole terminal and including a first movable contact, the first movable contact member reversibly movable about a corresponding first rotation axis according to a first rotation direction away from the first fixed contact and towards ground terminal or according to a second rotation direction, opposite to the first rotation direction, so that the first movable contact can be coupled to or uncoupled from the first fixed contact or ground terminal;

a second contact arrangement including a second fixed contact member and a second movable contact member, the second fixed contact member electrically connected to first pole terminal and including a second fixed contact, the second movable contact member including a second movable contact and reversibly movable along a corresponding translation axis, so that the second movable contact can be coupled to or decoupled from the second fixed contact;

a vacuum chamber, in which the second fixed contact and the second movable contact are enclosed and can be coupled or decoupled;

wherein, for each electric pole, switching apparatus comprises an electrically conductive coupling lever pivoted on the second movable contact member and reversibly movable about a second rotation axis according to a third rotation direction or according to a fourth rotation direction, opposite to the third rotation direction, wherein the coupling lever couples with and is actuated by the first movable contact member when the first movable contact member moves according to the first rotation direction, wherein the coupling lever electrically connects the second movable contact member with the first movable contact member when the coupling lever is coupled to the first movable contact member, wherein the coupling lever is moved according to the rotation direction (R3) to couple with a fixed mechanical element when the coupling lever is actuated by the first movable contact member, and wherein the coupling lever exerts on the second movable contact member an actuation force directed to move the second movable contact away from the second fixed contact.

2. The switching apparatus according to claim 1, wherein the coupling lever includes:

a first lever portion coupling with and being actuated by the first movable contact member when the first movable contact member moves according to the first rotation direction, the first lever portion electrically connecting the second movable contact member with the first movable contact member when coupled to the first movable contact member; and a second lever portion having a cam profile, the second lever portion coupling with the fixed mechanical element when the first lever portion is actuated by the first movable contact member and is moved according to the third rotation direction.

3. The switching apparatus according to claim 2, wherein the first lever portion has a free end having a forked shape and coupling with the first fixed contact when the coupling lever is in a rest portion.

4. The switching apparatus according to claim 2, wherein the first lever portion has a free end accommodated in a grooved seat of the first fixed contact and coupling with the first fixed contact when the coupling lever is in a rest position.

5. The switching apparatus according to claim 1, wherein the coupling lever has a reverse L-shaped body, a longer leg of the reverse L-shaped body forming the first lever portion, a shorter leg of the reverse L-shaped body forming the second lever portion.

6. The switching apparatus according to claim 1, wherein the movable contact member of each electric pole is reversibly movable between a first end-of-run position, which corresponds to a closed state of switching apparatus, and a second end-of-run position, which corresponds to a grounded state of switching apparatus, the movable contact member passing through an intermediate position, which corresponds to an open state of switching apparatus, when moving between the first and second end-of-run positions.

7. The switching apparatus according to claim 6, wherein, during an opening manoeuvre of switching apparatus, the first movable contact member moves according to the first rotation direction between the first end-of run position and the intermediate position, wherein, upon an initial movement according to the first rotation direction, the first movable contact member moves away from the first fixed contact member, thereby causing the first movable contact to decouple from the first fixed contact, and couples with the coupling lever, thereby actuating the coupling lever and moving the coupling lever away from a rest position, according to the third rotation direction.

8. The switching apparatus according to claim 7, wherein, upon a further movement according to the first rotation direction, the first movable contact member moves the coupling lever to a coupled position with the fixed mechanical element, thereby causing the coupling lever to interact mechanically with the fixed mechanical element and exert on the second movable contact member an actuation force directed to move the second movable contact member away from the second fixed contact member, thereby causing the second movable contact to decouple from the second fixed contact.

9. The switching apparatus according to claim 8, wherein, upon a further movement according to the first rotation direction, the first movable contact member decouples from the coupling lever and subsequently reaches the intermediate position, the coupling lever moving according to the fourth rotation direction to return in the rest position when the first movable contact member decouples from the coupling lever, the second movable contact member moving towards the second fixed contact member when the first movable contact member decouples from the coupling lever, thereby causing the second movable contact to couple with the second fixed contact.

10. The switching apparatus according to claim 1, wherein, during a disconnecting manoeuvre of switching apparatus, the first movable contact member moves according to the first rotation direction between the intermediate position and the second end-of-run position, wherein the first movable contact member couples with ground terminal when the first movable contact member reaches the second end-of-run position, thereby causing the first movable contact to couple with ground terminal.

11. The switching apparatus according to claim 1, wherein, during a reconnecting manoeuvre of switching apparatus, the first movable contact member moves according to the second rotation direction between the second end-of-run position and the intermediate position, wherein the first movable contact member moves away from ground terminal, thereby causing the first movable contact to decouple from ground terminal.

12. The switching apparatus according to claim 1, wherein, during a closing manoeuvre of switching apparatus, the first movable contact member moves according to the second rotation direction between the intermediate position and the first end-of-run position, wherein, upon an initial movement according to the second rotation direction, the first movable contact member reaches the first fixed contact member before the coupling lever when moving towards the first end-of run position, thereby causing the first fixed contact to couple with the first movable contact before engaging the coupling lever.

13. The switching apparatus according to claim 12, wherein, upon a further movement according to the second rotation direction, the first movable contact member couples with the coupling lever, thereby actuating the coupling lever and moving the coupling lever away from a rest position, according to a fourth rotation direction.

14. The switching apparatus according to claim 13, wherein, upon a further movement according to the second rotation direction, the first movable contact member decouples from the coupling lever and reaches the first end-of-run position, the coupling lever moving according to the third rotation direction to return in the rest position when the first movable contact member decouples from the coupling lever.

15. The switching apparatus according to claim 1, wherein switching apparatus is a load-break switch for medium voltage electric systems.

* * * * *